US005540639A

United States Patent [19]

Potts et al.

[11] Patent Number: 5,540,639

[45] **Date of Patent: * Jul. 30, 1996**

[54] DEVICE TO PREVENT ARCUATE MOTION OF A USER ASSIST PLATFORM FOR AN UPPER BODY EXERCISE APPARATUS

[75] Inventors: Lanny L. Potts, deceased, late of Skiatook, by Donna G. Potts, legal representative; Fred H. Holmes, Tulsa, both of Okla.

[73] Assignee: StairMaster Sports/Medical Products, Inc., Kirkland, Wash.

[ * ] Notice: The portion of the term of this patent subsequent to May 17, 2011, has been disclaimed.

[21] Appl. No.: 124,673

[22] Filed: Sep. 21, 1993

Related U.S. Application Data

[63] Continuation of Ser. No. 685,364, Apr. 15, 1991, abandoned.

[51] Int. Cl.[6] ..... A63B 21/062

[52] U.S. Cl. ..... 482/95; 482/92

[58] Field of Search ..... 482/51, 95, 96, 482/52, 94, 148, 92

[56] References Cited

U.S. PATENT DOCUMENTS

| | | | |
|---|---|---|---|
| 248,121 | 10/1881 | Tuttle | 482/96 |
| 1,521,487 | 12/1924 | Turner . | |
| 1,854,473 | 4/1932 | Laborda . | |
| 2,253,996 | 8/1941 | Bechman . | |
| 3,062,542 | 11/1962 | Evancha . | |
| 3,128,094 | 4/1964 | Wolf | 482/111 |
| 3,394,934 | 7/1968 | Elia et al. | 482/95 |
| 3,495,824 | 2/1970 | Cuinier . | |
| 3,497,215 | 2/1970 | Harrison . | |
| 3,511,500 | 5/1970 | Dunn . | |
| 3,529,474 | 9/1970 | Olson . | |
| 3,582,069 | 6/1971 | Flick . | |
| 3,587,319 | 6/1971 | Andrews . | |
| 3,589,193 | 6/1971 | Thornton . | |
| 3,592,465 | 7/1971 | Fulkerson, Jr. . | |
| 3,592,466 | 7/1971 | Parsons . | |
| 3,628,791 | 12/1971 | Garcia . | |
| 3,638,941 | 2/1972 | Kulkens | 482/113 |
| 3,701,529 | 10/1972 | Kruthaupt . | |
| 3,704,886 | 12/1972 | Kay et al. . | |
| 3,707,285 | 12/1972 | Martin . | |
| 3,708,167 | 1/1973 | Potgieter . | |
| 3,716,231 | 2/1973 | Martin . | |
| 3,747,924 | 7/1973 | Champoux . | |
| 3,756,595 | 9/1973 | Hague . | |
| 3,758,112 | 9/1973 | Crum et al. . | |
| 3,759,511 | 9/1973 | Zinkin et al. . | |
| 3,765,245 | 10/1973 | Hampl . | |
| 3,824,994 | 7/1974 | Soderberg, Sr. . | |
| 3,970,302 | 7/1976 | McFee . | |
| 4,063,726 | 12/1977 | Wilson . | |
| 4,082,267 | 4/1978 | Flavell . | |
| 4,084,810 | 4/1978 | Forsman . | |
| 4,111,414 | 9/1978 | Roberts . | |
| 4,112,928 | 9/1978 | Putsch . | |
| 4,220,996 | 9/1980 | Searcy . | |
| 4,235,437 | 11/1980 | Ruis et al. . | |
| 4,298,893 | 11/1981 | Holmes . | |
| 4,325,547 | 4/1982 | Cook . | |
| 4,341,380 | 7/1982 | Sauder . | |

(List continued on next page.)

*Primary Examiner*—Stephen R. Crow
*Attorney, Agent, or Firm*—Seed and Berry LLP

[57] ABSTRACT

An upper body exercise apparatus to assist an exerciser to do chin-ups and dips. The apparatus includes a frame having a base, a platform parallel to the base for the exerciser to stand on, and chin-up handles and dip handles extending from the frame. A motive device oscillates the platform vertically between a lower position and an upper position while maintaining the platform parallel to the base. Angular displacement of the platform is prevented by attaching the platform to a guide member which permits the platform to travel vertically along the device frameposts but does not permit the platform to travel horizontally relative to the frameposts. The guide members can comprise a set of rollers or collars. The system further includes a control and monitor whereby the force is controlled and the oscillation of the platform is monitored.

24 Claims, 10 Drawing Sheets

U.S. PATENT DOCUMENTS 4,358,105 11/1982 Sweeney, Jr. .
4,416,293 11/1983 Anderson et al. .
4,452,447 6/1984 Lepley et al. .
4,468,025 8/1984 Sferle .
4,470,597 9/1984 McFee .
4,496,147 1/1985 De Cloux et al. .
4,512,566 4/1985 Bicocchi .
4,537,395 8/1985 Spinelli .
4,576,539 3/1986 Williams .
4,620,701 11/1986 Mojden .
4,645,197 2/1987 McFee .
4,687,195 8/1987 Potts .
4,708,338 11/1987 Potts .
4,720,093 1/1988 Del Mar .
4,846,458 7/1989 Potts .
4,941,659 7/1992 Silvestri .
5,011,139 4/1991 Towley, III .
5,033,735 7/1991 Erickson .
5,312,313 5/1994 Holmes et al. ..... 482/95

DEVICE TO PREVENT ARCUATE MOTION OF A USER ASSIST PLATFORM FOR AN UPPER BODY EXERCISE APPARATUS

This is a Continuation of application Ser. No. 07/685, 364, filed Apr. 15, 1991, now abandoned.

BACKGROUND OF THE INVENTION

The present invention relates to an improved exercise device for the upper body muscles that provides an upward, vertical force to assist the exerciser with chin-ups and dips. Chin-up or dip exercises require strong upper body muscles. In most exercisers, these upper body muscles are not sufficiently developed and the exercises can only be performed with great difficulty if at all.

Typical upper body exercise apparatuses either provide no assistance to the exerciser or are cumbersome to use and operate. For example, the device described in the patent to Roberts, U.S. Pat. No. 4,111,414, requires the user to step into a harness while manually adjusting weights. Other devices provide a platform on which the exerciser stands, but the force applied to assist the exerciser either causes arcuate motion of the platform, or provides a non-linear assist force.

In particular, McFee in U.S. Pat. No. 4,470,587, illustrates an oscillating platform articulated to a parallelogram assembly having fixed pivot points. Thus, as the platform moves from an initial position to an upper position, the platform must necessarily traverse an arc. The arcuate motion of the platform causes the user's feet to traverse an arc while the user's hands grip the chin-up or dip handles and a true chin-up or dip exercise cannot be performed.

The Martin device, U.S. Pat. No. 4,452,447, contains an oscillating platform attached to elastic spring members which provide an upward force to assist the user. The elastic members behave in a similar fashion to springs and the amount of assistance force therefore varies with the displacement of the platform.

One device described in Potts U.S. Pat. No. 4,846,458, does disclose an oscillating platform with essentially uniform upward force and free of arcuate motion. The Potts' device uses a system of levers and hydraulic lifts to move the platform. As the platform moves up and down, a short arm causes the effective length of the moment arm to change. The change in moment arm compensates for the nonlinearity of the pneumatic lifters and provides a substantially linear assist force to the platform. An accumulator and air compressor motor are used to control the volume of fluid in the pneumatic cylinder and thus the amount of assist provided to the user. The intricate lever system also prevents arcuate motion of the assist platform.

Although this device achieves an essentially constant upward force with no arcuate motion of the platform, a multiplicity of pneumatic devices and levers is needed. These pneumatic devices and levers increase the cost of manufacturing in terms of both component costs and labor. The complexity of the device also negatively impacts reliability. The pneumatic cylinders of the device also require a period of time to charge to the desired level. Similarly, when the user has completed exercising on the device, a period of time is required for the cylinders to fully discharge before the user can step off the machine.

SUMMARY OF THE INVENTION

According to one embodiment, the present invention contains an oscillating platform which provides a vertical force to assist the user in performing chin-up and dip exercises. The platform contains a set of rollers which guide the platform vertically along the frame posts of the device. The rollers prevent horizontal displacement of the platform and thus prevent platform arcuate motion. The motive force may be provided to the platform in numerous ways. Devices 104 (FIG. 12A) for providing the force to the platform can include but are not limited to: a rack and pinion driven by electric motor; a spring; pneumatic cylinders; a weight stack; or a vacuum cylinder.

The use of rollers to guide the platform vertically and prevent horizontal travel eliminates the need for a complex system of moment arms and levers. This reduced complexity improves reliability and reduces costs over other upper body exercise systems. Further reductions in cost and complexity are possible by using fewer of the rollers to support the platform. According to other embodiments of the invention, the rollers are replaced by a gliding mechanism such as a Delrin insert, a plastic bushing, or a metal collar around the vertical column.

The device of the present invention thus provides the user with a more convenient, more reliable, less costly means for doing assisted dip and chin-up exercises. The exercise apparatus of the present invention permits users of various abilities to perform the upper body exercises in proper form by providing a variable, but substantially linear assist force to the platform without inducing platform arcuate motion. The exercise device of the present invention thus enables persons of all fitness levels to perform proper dip and chin-up exercises. The reduced complexity of the device also means that the exercise benefits of the device can be had at a reduced cost.

DESCRIPTION OF SPECIFIC EMBODIMENTS

Figure 1:
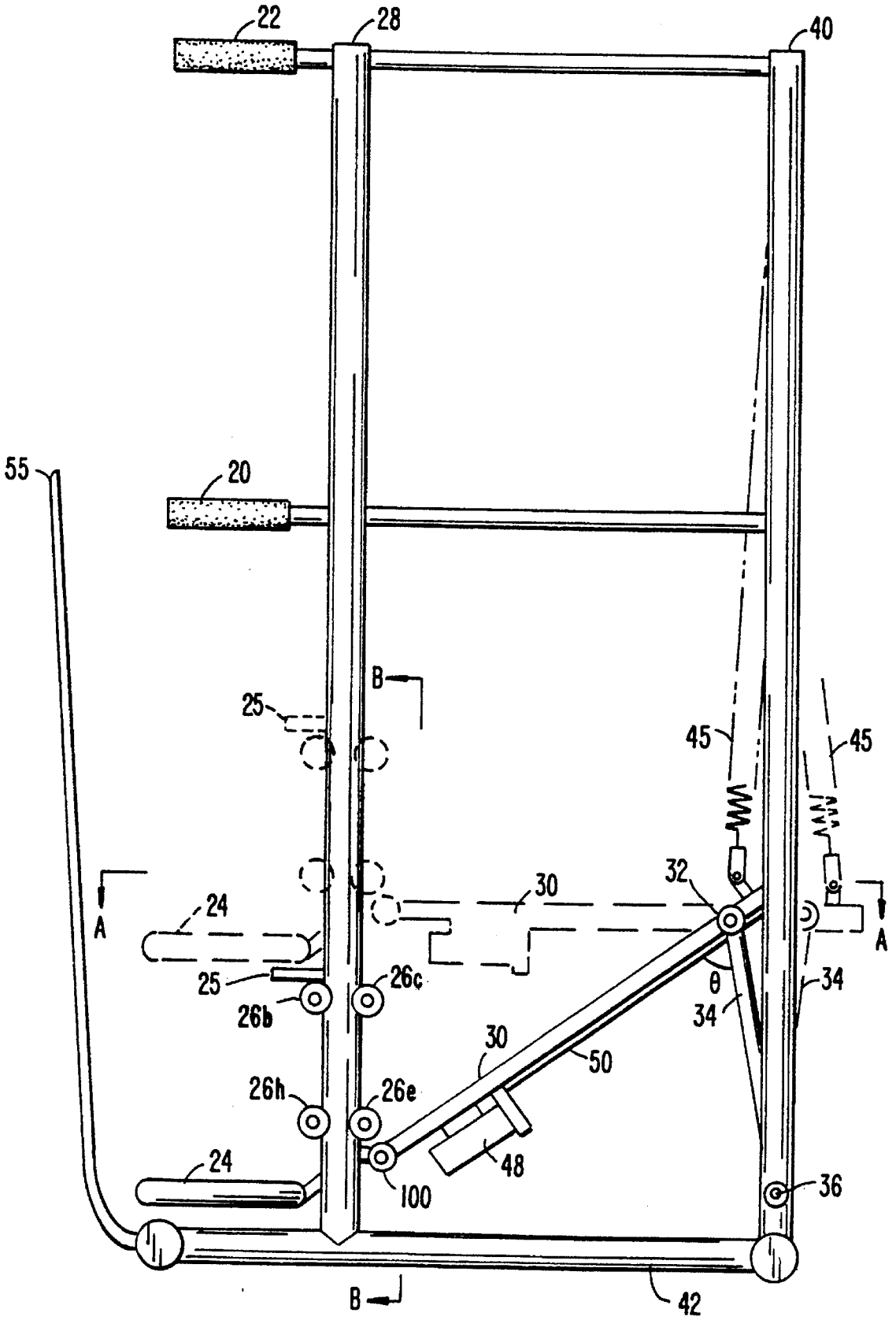
FIG. 1 is a side view of an upper body exercise apparatus according to an embodiment of the present invention.

FIG. 1 shows a side view of an exercise apparatus on which chin-ups and dips can be performed according to one embodiment of the present invention. To perform a dip exercise, the exerciser begins with the arms extended downward, and hands gripping handles 20. Handles 20 and 22 are covered by a grip to prevent slipping. The exerciser lowers the body by bending at the elbows and then straightens the elbows to lift the body back to the starting position. To perform a chin-up, the exerciser grabs handle 22 located above his/her head and pulls the body upward. In both exercises, the exerciser must overcome the force of gravity. Repetitions of the exercises develop strength and stamina and also promote physical fitness.

Not every exerciser has developed the muscle strength necessary to counteract their own weight and perform chin-up and dip exercises unassisted, or to perform repetitions of the exercise. The exercise device of the present invention therefore includes mechanisms which can provide a vertical force opposite the force of gravity to counteract the exerciser's weight and assist in performance of the exercises.

Figure 2:
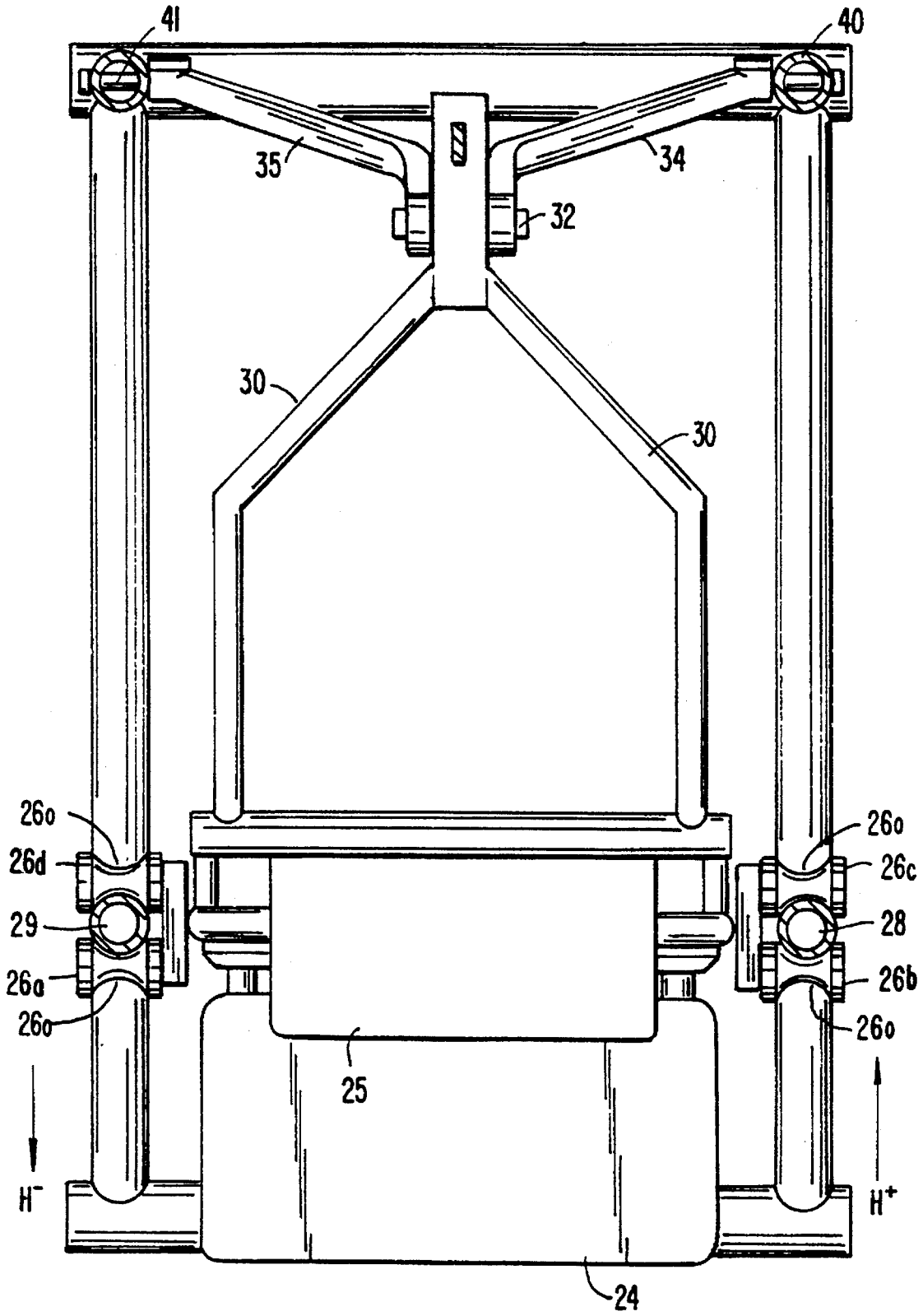
FIG. 2 shows section A—A of the drawing of an upper body exercise apparatus as shown in FIG. 1.

One embodiment of the present invention includes an L-shaped platform 24 on which the exerciser may stand or otherwise mount the apparatus. A step 25 is provided on the vertical portion of L-shaped platform 24 to assist users in reaching the upper set of handles 22. In this embodiment, the vertical portion of L-shaped platform 24 also contains a set of four rollers 26 which are located around each side of vertical frame posts 28 and 29. FIG. 2 shows section A—A of FIG. 1 which illustrates this arrangement more clearly. Alternately, the top set of rollers 26 may be omitted to curb production costs in this embodiment of the invention. Rollers 26 allow platform 24 to travel vertically along frame posts 28 and 29 and prevent the platform from travelling horizontally thereby ensuring that platform 24 has no arcuate motion. Section B—B of FIG. 1 shown in FIG. 3 shows travel of platform 24 from first elevated position, indicated by dashed lines, to a second, floor level position.

Figure 3:
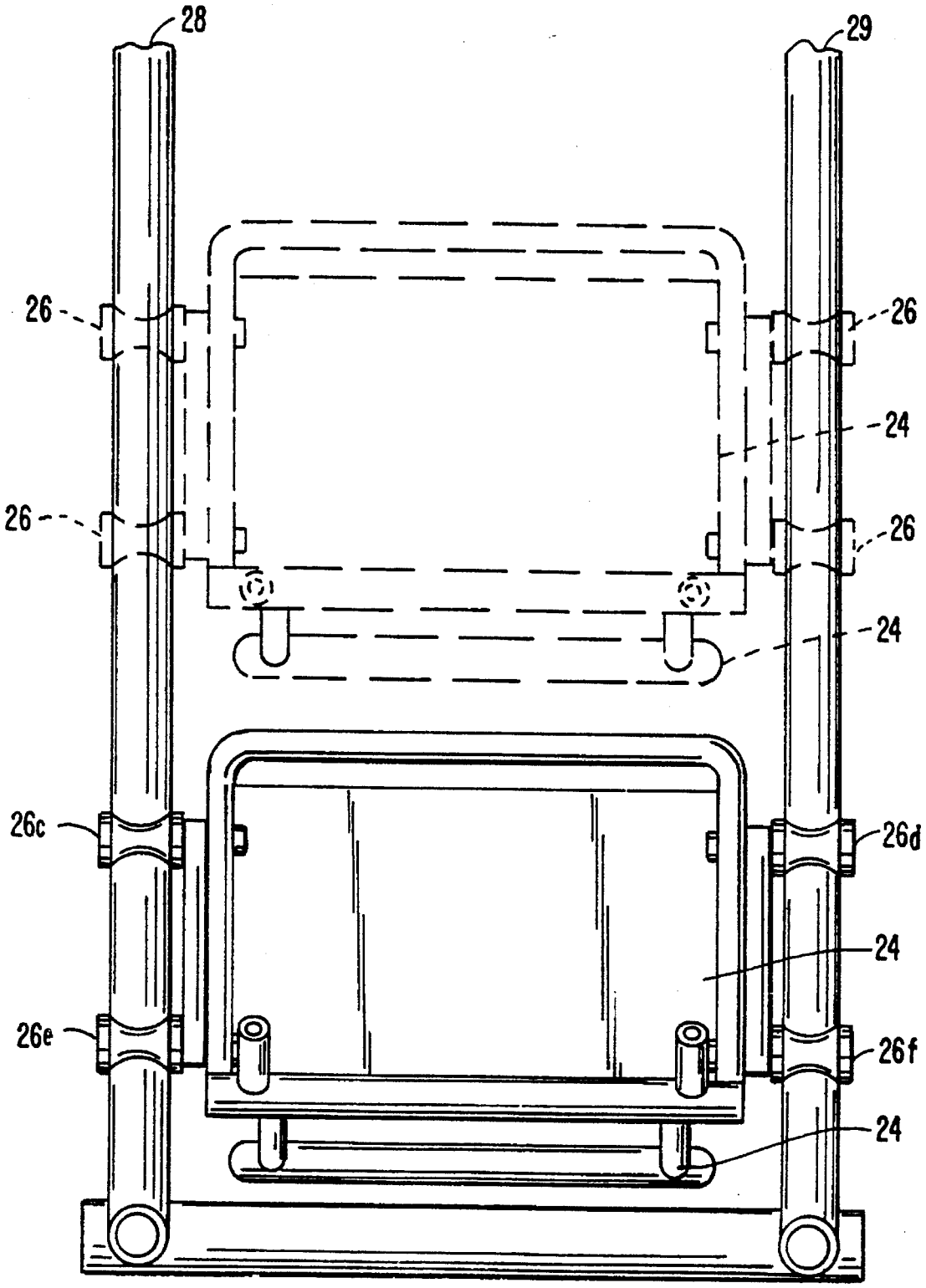
FIG. 3 shows section B—B of the drawing of an upper body exercise apparatus as shown in FIG. 1.

FIGS. 1–3 illustrate the arrangement of rollers 26 about the framepost 28, 29. One roller, 26*a*–26*d* is located to each side of the post. As platform 24 travels vertically, rollers 26 rotate to permit rollers 26 to glide along posts 28, 29 where the outer surface 26*o* of rollers 26 contacts the perimeter of posts 28 and 29. Horizontal travel of platform 24 in the direction shown by arrow H+ of the figure is resisted by reaction of rollers 26*a–b*, 26*g* (now shown) and 26*h* against the framepost. Similarly, horizontal travel of platform 24 in the direction indicated by arrow H– of the figures is resisted by the reaction of rollers 26*c–d* and 26*e–f* against the frameposts.

Figure 4A:
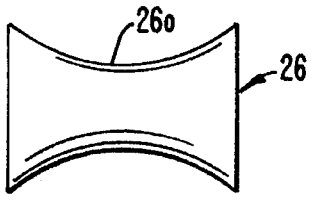
FIGS. 4A and 4B show a roller, as used in an embodiment of the present invention, in isolation.
Figure 4B:
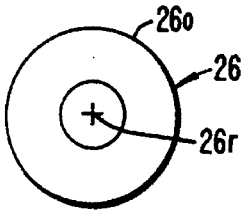

FIGS. 4A and 4B show a roller 26 in isolation. Rollers 26 contain an outer surface 26*o* which can be formed from a variety of materials including steel or hard durable plastic. Outer surface 26*o* is not a straight, but is a curved surface. The curvature is circular in nature and has a constant radius approximately equal to the radius of the frameposts. The length of outer surface 26 should be of sufficient length to prevent horizontal motion in a direction perpendicular to H+ and H–. The outer surface 26*o* thus fits snugly against the outer surface of the frameposts. Outer surface 26*o* is rotatable about bearing 26*r*. Rotation of outer surface 26*o* about bearing 26*r* permits rollers 26 to travel along the length of frameposts 28 and 29.

Figure 5:
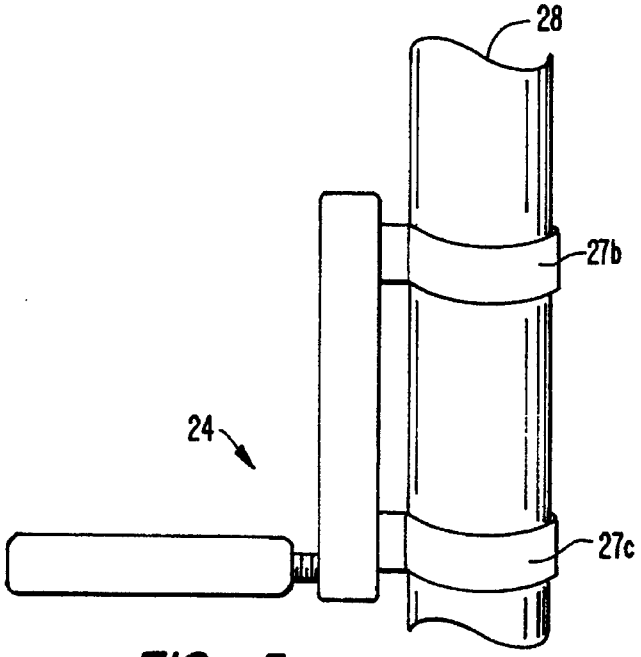
FIG. 5 shows a side view of a user assist platform secured to exercise apparatus frameposts with collars according to an embodiment of the present invention.
Figure 6:
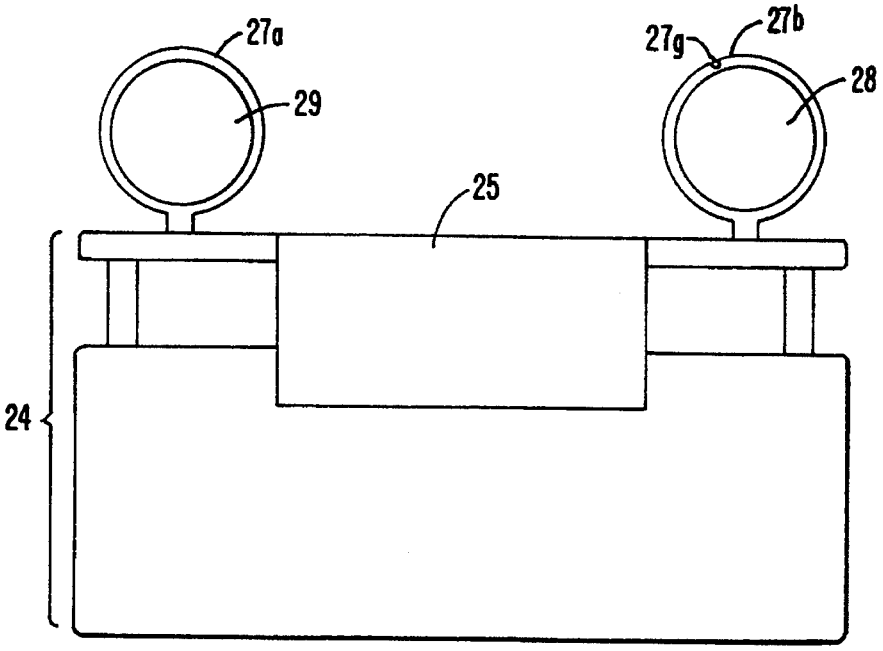
FIG. 6 shows a top view of a user assist platform secured to exercise apparatus frameposts according to an embodiment of the present invention.

Alternately, platform 24 may contain various types of guide members in lieu of rollers. The guide members used should provide sufficient support to platform 24 such that the platform does not tilt or sway and throw the user. FIGS. 5 and 6 show one such alternate guide member arrangement according to an embodiment of the present invention. In the figs. a collar 27 is secured at one end to platform 24 and wraps around vertical support posts 28 and 29. Collars 27 are ideally provided at four points of platform 24 to obtain maximum stability of the platform. Two collars can possibly be used to further reduce costs.

The collars, like the rollers, slide along the frameposts and permit platform 24 to travel in only a vertical direction. Horizontal motion of the platform is resisted by the inability of the collar to move horizontally with respect to the framepost and the reaction of the collar against the framepost when a horizontal force component is introduced to the system. Therefore, to ensure proper functioning of the collar structure, collars 27 should encompass frameposts 28 and 29 with sufficient clearance to permit vertical travel along the frameposts, but should have limited clearance to restrict horizontal freedom of movement. Collars may be fabricated to completely encircle the frameposts as is shown by 27*a* of FIG. 6. Collars 27 can also contain a small gap 27*g* as shown by 27*b* of the Figure. Gap 27*g* permits easy assembly of the apparatus since collars 27 need not be threaded onto the frameposts from one end but can be placed around the posts. Once around the posts gap 27*g* can be tightened to conform collars 27 to the desired diameter. Gap 27 also permits the diameter of collar 27 to be adjusted to account for thermal strain of collars and posts caused by climate changes.

Collars 27 can be fabricated from a variety of materials. One such material is Delrin™, a plastic resin material manufactured by DuPont of Wilmington, Del. Delrin™ has the advantage of being a self lubricating material. Collars 27 can also be fabricated from steel, other metals and plastics. These materials, however, must be lubricated by maintenance personnel to reduce friction, wear and noise. Nevertheless, the collars are likely to be more noisy and less smooth than the rollers.

Motive force can be provided to platform 24 in a variety of fashions. For example, the motive force can be provided by: a weight stack; a vacuum cylinder; a pneumatic cylinder or an electric motor. By way of illustrating the principles of the present invention, in the embodiment of FIG. 1, L-shaped platform 24 is shown connected by a first pivot 100 to an actuating arm 30 which has a second pivot 32 located some distance from platform 24. One end of a pivoting rod 34, 35 attaches to actuating arm 30 at pivot point 32 and to a second pivot 36, 37 located on vertical supports 40 and 41 near the base 42 of the apparatus. A spring 45 is also attached to actuating arm 30 and secured to the device frame. Spring 45 provides a motive force to platform 24 which oscillates the platform vertically. The position of spring 45 relative to pivot 32 determines the amount and direction of the force applied to platform 24 by varying the moment about pivot 32. An electric motor 48, drives a jack screw 50 to position the spring along actuating arm 30. In FIG. 1, spring 45 is positioned aft of pivot 32. The force exerted by spring 45 on actuator arm 30 has therefore caused platform 24 to move from an elevated position, as shown by dashed lines in the figure, to a floor level position shown in solid lines.

As platform 24 moves vertically, pivoting rod 34 traverses an arc. The arc motion of rod 34 would normally pull actuating arm 30 away from frameposts 28 and 29 causing arcuate motion of platform 24. Any arcuate motion of the platform would corrupt the desired form of the dip or chin-up exercise and would also vary the magnitude of the vertical assist force provided to the user. Arcuate motion of the platform 24 is resisted, however, by the reaction of rollers 26 against frameposts 28, 29. The reaction of the rollers 26 against the frameposts allows the angle 8 between the rods 30 and 34 to change as the platform rises. The motion of platform 24 thus remains vertical and undesirable arcuate motion of the platform is prevented.

The arc motion of rod 34 also causes slight changes in the length of spring 45 and also in the length of the moment arm as angle θ changes. On the vertically ascending portion of the arc, spring 45 contracts and the force exerted by spring 45 decreases. Conversely, on the descending portion of the arc traversed by rod 34, spring 45 lengthens with a corresponding increase in force. These force and moment arm variations if uncorrected, provide a nonconstant assist force to the user.

To compensate for the spring force variations, electric motor 48 and jack screw 50 alter the attach position of spring 45 during motion of platform 24. As spring 45 shortens during upward vertical motion of platform 24, jack screw 50 drives the spring attach point from the initial point to a point further from pivot 32. The increased distance from pivot 32 compensates for the decrease in spring force and maintains a moment of constant magnitude about pivot 32. The mechanism of the present invention thus provides a substantially constant force to platform 24 and the degree of assistance provided to the user at the beginning of an exercise stroke is identical to the assistance provided at the end of the exercise stroke.

Figure 7:
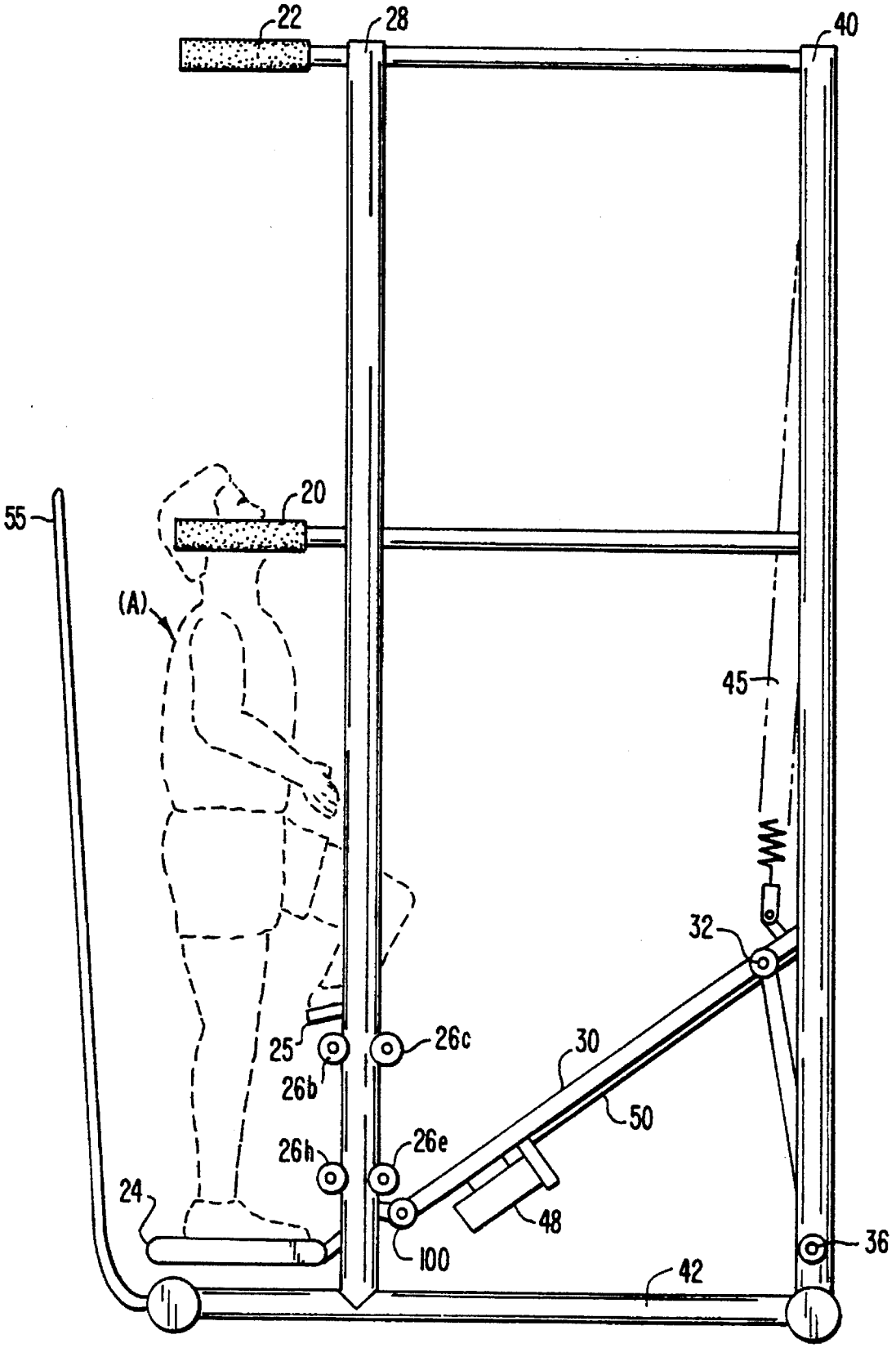
FIG. 7 shows an exerciser mounting an upper body exercise apparatus according to an embodiment of the present invention.
Figure 9:
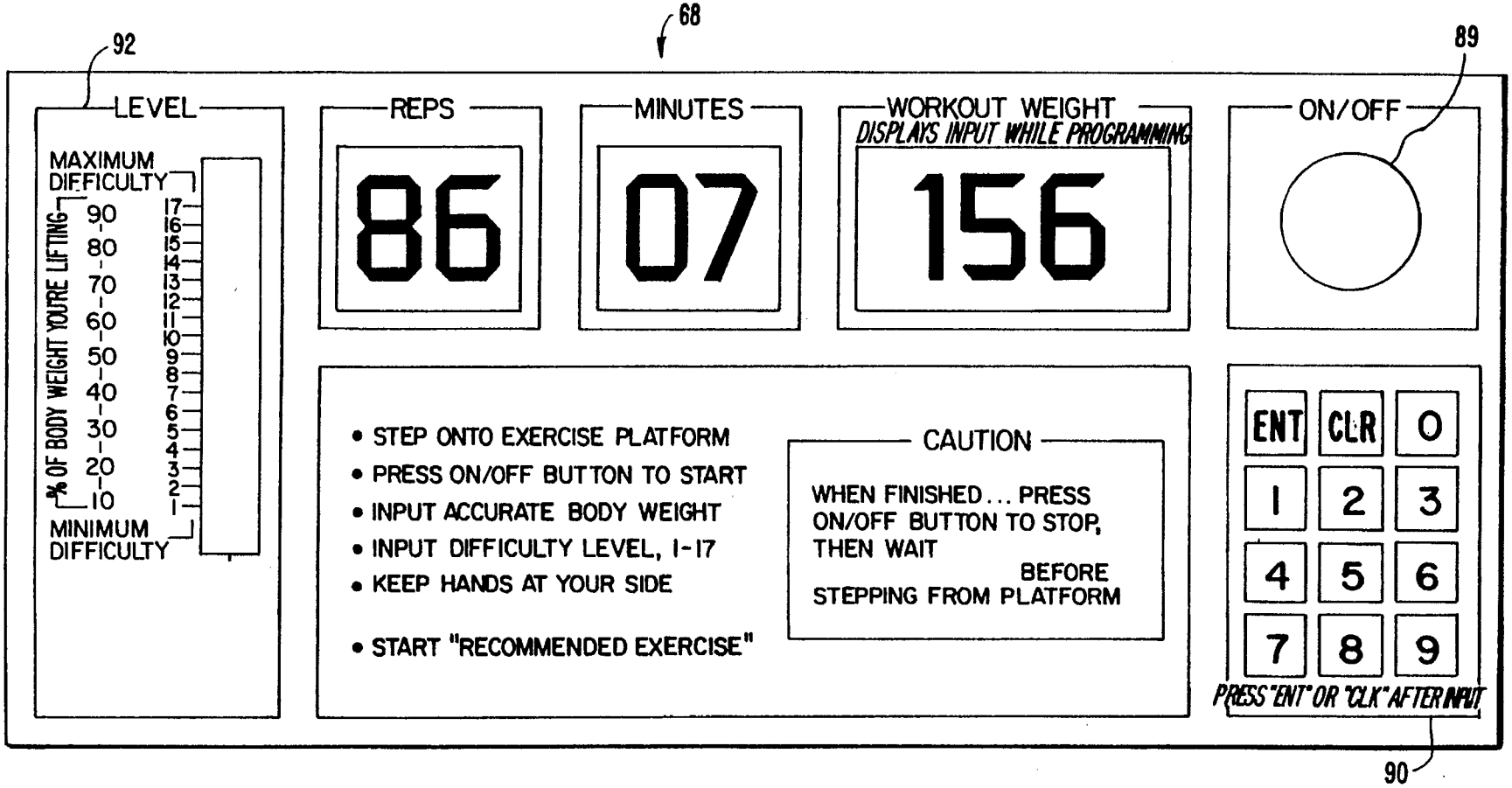
FIG. 9 shows a control console according to an embodiment of the present invention.

The operation of this embodiment of the invention is best shown by way of example. FIG. 7 shows a user A stepping onto platform 24 to begin a chin-up exercise. A safety rail 55 prevents user A from falling backwards off platform 24. Once on platform 24, user A faces a control monitor 68 (not visible in FIG. 7). An enlarged view of the monitor 68 is drawn in FIG. 9. After turning on the apparatus with switch 89, the exerciser enters his/her weight using keypad 90. The amount of upward assistance force desired by the user can be entered as a percentage of the user's weight using bar graph 92. Panel 68 then displays the net weight to be lifted. The microprocessor, since it provides instructions regarding the exercise, can store indications of the elapsed exercise time and the number of repetitions of the exercise. As the exercise is performed, the number of repetitions and elapsed time will also be displayed, using the display unit.

Control panel 68 contains a microprocessor which controls electric motor 48. The microprocessor computes the weight to be lifted as the given percentage of the entered weight. The distance of spring 45 from pivot 32 necessary to impart this force to the platform is then calculated according to well known techniques. For example, the relationship $\overline{M}_1=\overline{F}_1\times\overline{d}_1=\overline{F}_2\times\overline{d}_2$ where:

$\overline{M}$=moment about the pivot $\overline{F}_1$= spring force $\overline{F}_2$= % weight to be lifted by the platform $\overline{d}_1$= distance from the spring attach point to the pivot $\overline{d}_2$= distance from the center of the platform to the pivot can be used.

Figure 8:
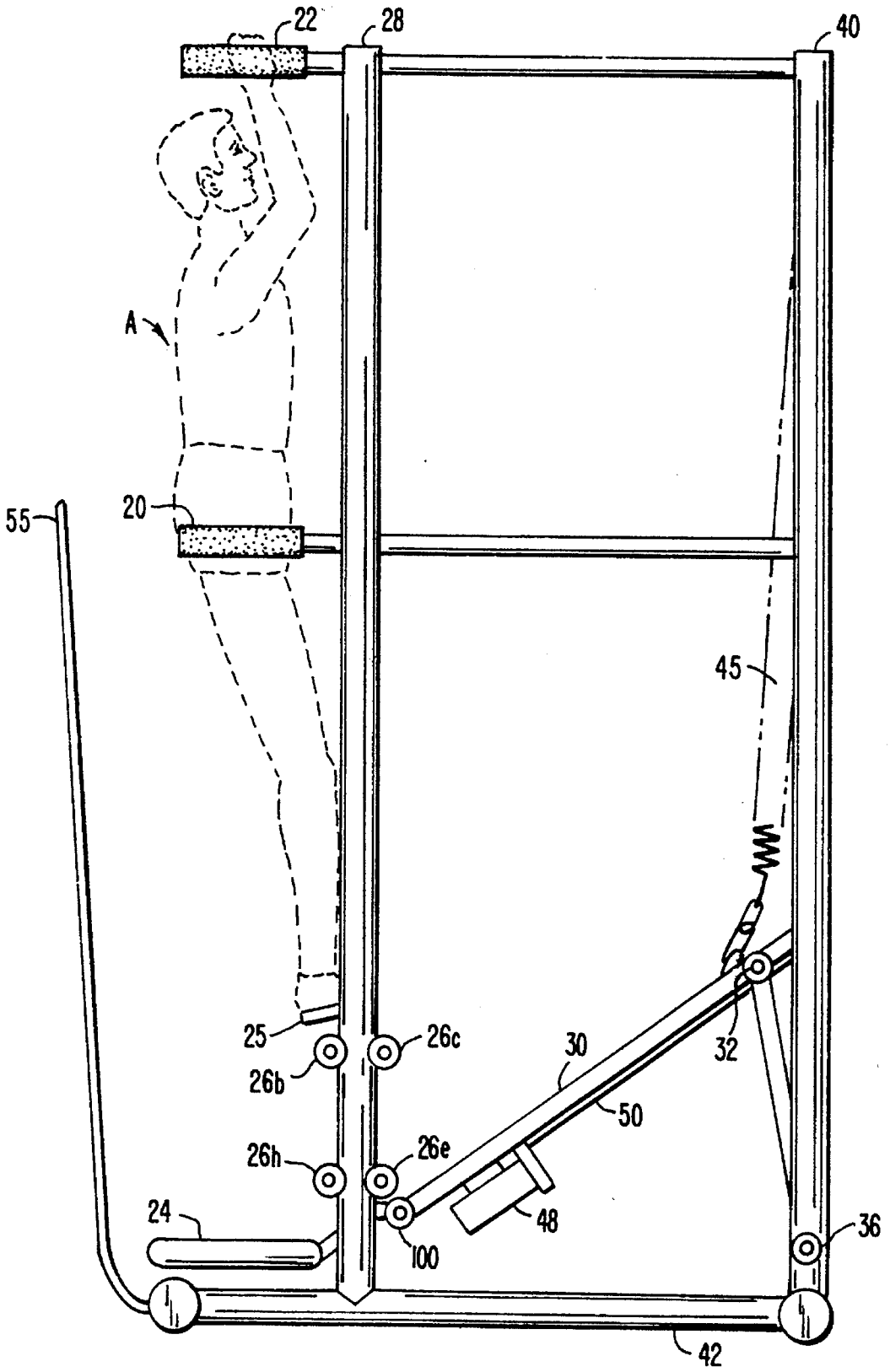
FIG. 8 shows an exerciser in position to grab chin-up exercise handles according to an embodiment of the present invention.

In response to the microprocessor, electric motor 48 drives jack screw 50 the required number of revolutions to position spring 45 in the desired position along actuating arm 30. The desired upward force is imparted to platform 24 once spring 45 is in this position. The sum of the vertical forces on platform 24 equals the user's weight plus the upward vertical force provided to the platform by the spring mechanism. So long as the percentage weight to be lifted by platform 24 is less than 100%, the net vertical force will be down and platform 24 will remain at floor level when user A is at rest. A large number of people cannot reach handles 22 when platform 24 is at floor level. To reach handles 22, user A must step on step 25 as shown in FIGS. 7 and 8. With both feet on step 25, user A can now easily grab onto handles 22. User A can now support enough of his own weight by clasping handles 22, that the net force on platform 24 is vertically upward and the platform begins to rise. Once platform 24 has travelled a sufficient distance, user A may step back down onto platform 24 as shown in FIG. 10 to begin the chin-up exercise.

Users of various sizes need only wait until platform 24 travels to the height preferred by that user for beginning the exercise. Exercisers of all sizes are accommodated by this procedure. No need to adjust the handles exists because platform 24 travels upward to meet the user. Handles 20 and 22 can therefore be fabricated as fixed elements to save costs over systems requiring adjustable handles. Alternatively, however, the upper body exercise apparatus may be fabricated with adjustable handles.

Figure 10:
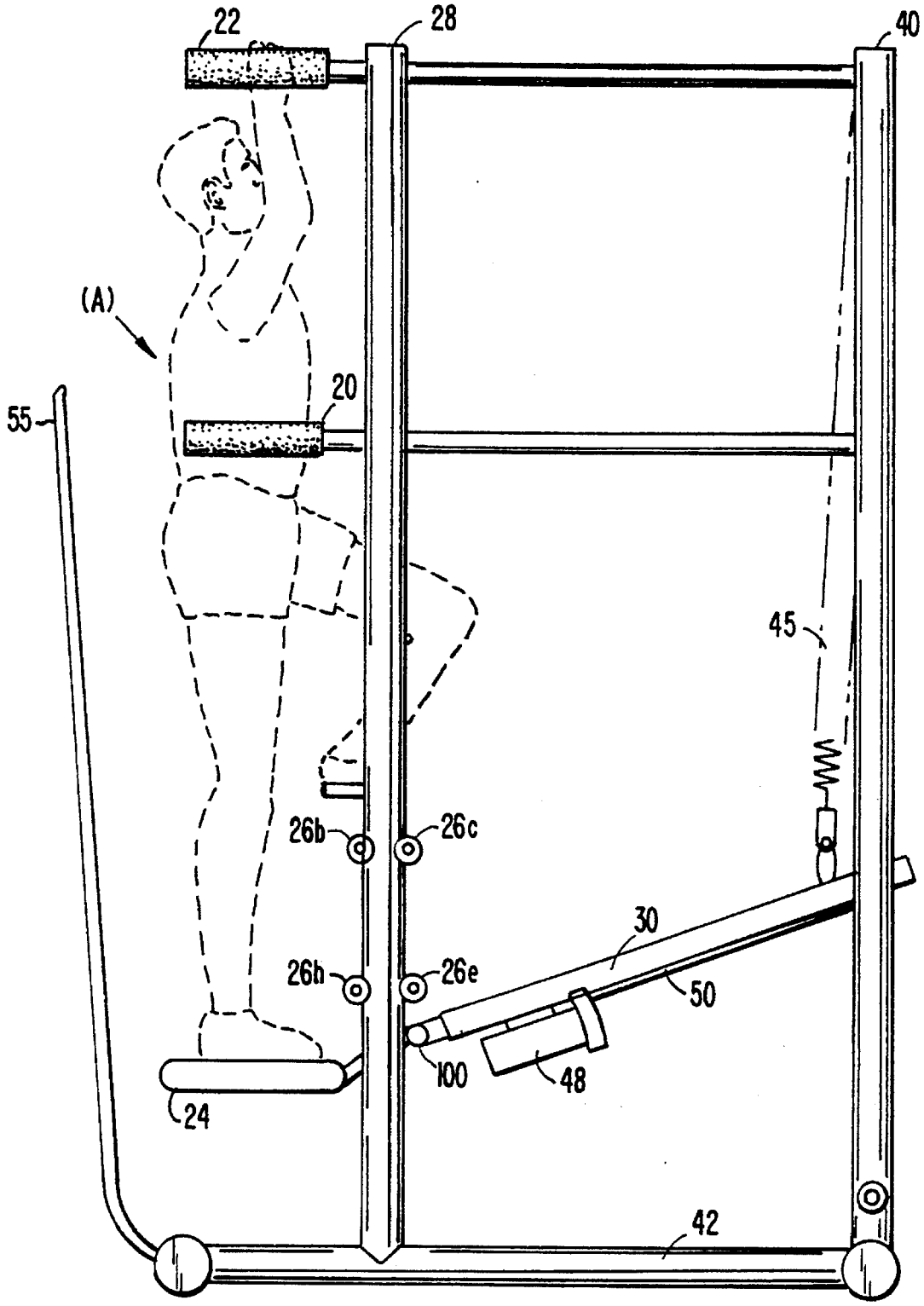
FIG. 10 shows an exerciser stepping into an initial starting position for a chin-up exercise according to an embodiment of the present invention.

From the initial starting position shown in FIG. 10, Exerciser A then begins to pull himself up with the aid of the force supplied by the platform. As the exerciser moves in an upward vertical direction, L-shaped platform 24 travels upward along frame posts 28 and 29. Rollers 26 prevent arcuate motion of L-shaped platform 24 by preventing horizontal displacement of the platform relative to vertical frame posts 28 and 29. As the platform rises contact frame of the rollers 26, 27 with the posts 28 and 29 provides a force which causes member 34 to pivot about pivot 36 as the height of the platform increases. Motion of platform 24 during the upward exercise stroke is kept vertical by contact of rollers **26*a–b* and 26*g–h* with frame posts 28 and 29** which prevent horizontal travel of the platform.

Figure 11:
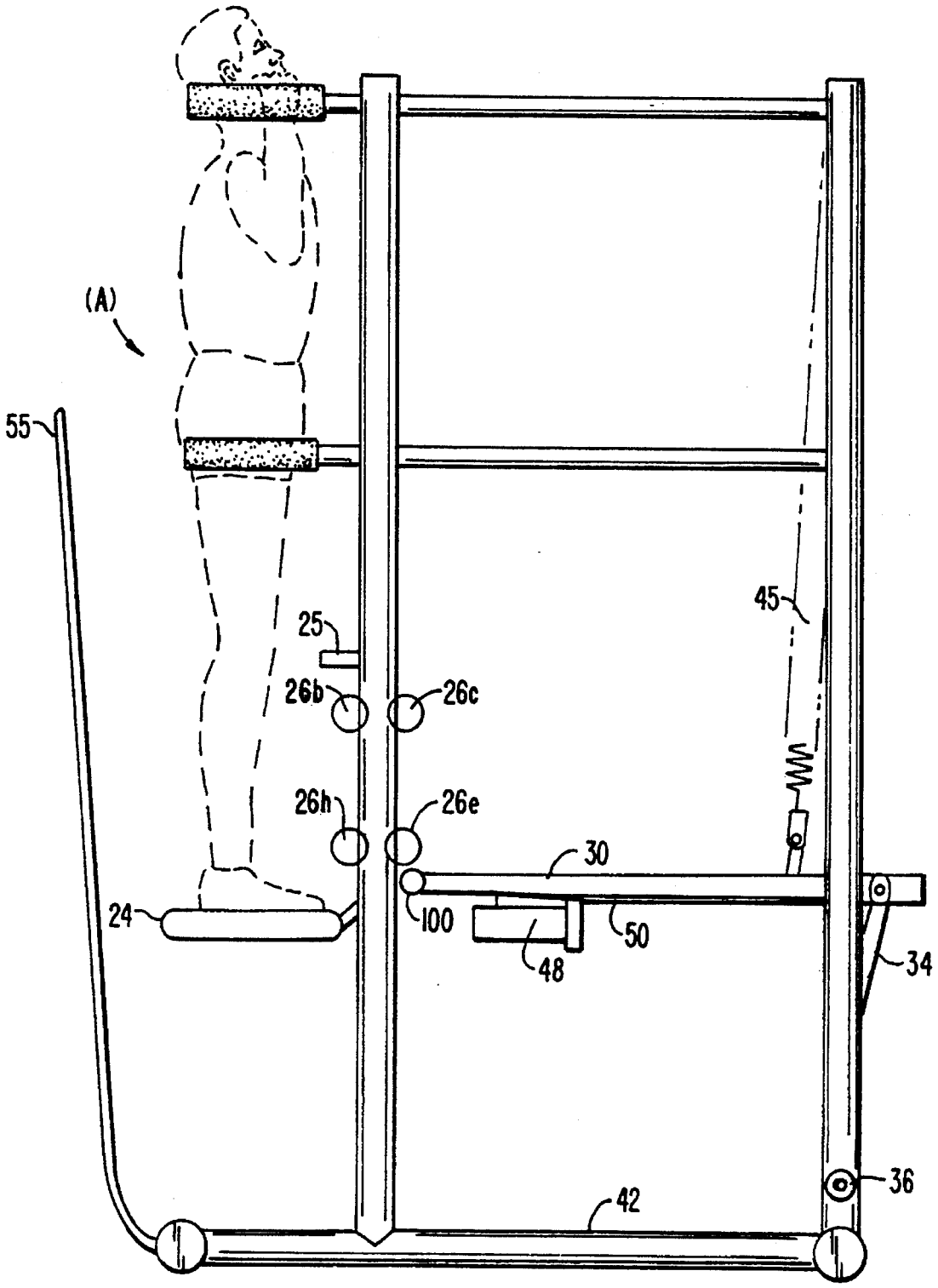
FIG. 11 shows an exerciser in a completed chin-up exercise according to an embodiment of the present invention.

Once at the top of the upward stroke of the exercise shown in FIG. 11, the exerciser stops exerting an upward force to pull himself up. The upward force exerted by the exerciser and the upward force imparted to the exerciser via platform 24 provide the net force necessary to complete the upward stroke of the exercise. When the exerciser ceases to exert an upward force, the exerciser's own weight will be greater than and in an opposite direction from the upward force provided by platform 24. Platform 24 will slowly sink back to the initial starting position and repetitions of the exercise may be performed.

Upon completion of the desired number of exercises, User A can let go of handles 22 and remain at rest. Platform 24 will slowly sink back to the floor position since the user's weight exceeds the upward force provided by the platform. Motor 48 and jack screw 50 then position the attach point of spring 45 aft of pivot 32 so that platform 24 remains at floor level. In this configuration, User A can dismount the machine and subsequent users mount the machine.

As may be seen from the above description, the present invention provides a system for assisting the user in chin-up and dip exercises with a constant force and free of arcuate motion. The present invention achieves these ends without the need for a complicated system of hydraulic devices and levers. For this reason, the exercise apparatus of the present invention may be had at reduced cost and with improved convenience and reliability.

Figure 12A:
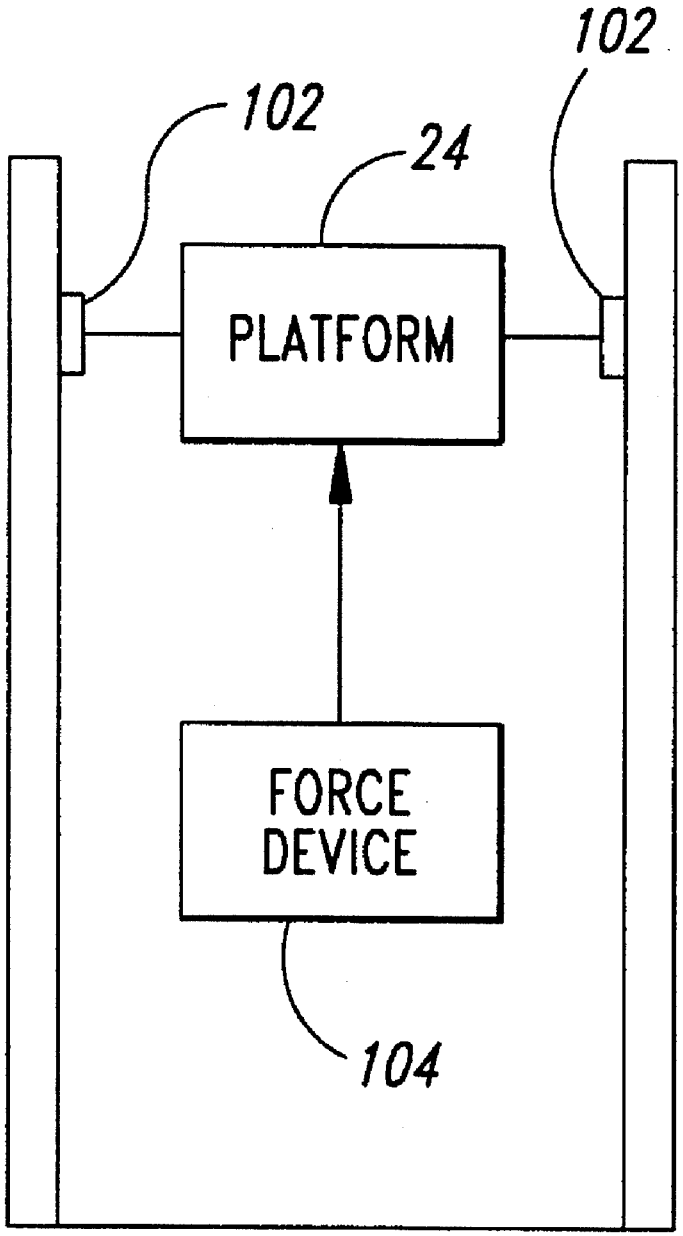
FIG. 12A is a schematic block diagram of the relationship of the force device and guide members to the platform, according to the embodiments of the present invention.

The preferred embodiments of the invention have now been described. Variations and modifications will be readily apparent to those skilled in the art. For example, the method of computing spring position along the actuator arm may take many forms, including but not limited to, finite element analysis, numerical analysis and computation by direct measure. In addition, the motive force to the platform can be provided from many sources and devices other than the particular spring mechanism described herein. Also, console 68 may have many variations in the organization and types of information input and displayed. Furthermore, other mechanisms 102 (FIG. 12A) which guide vertical travel of platform 24 along the frameposts and prevent horizontal motion, such as rails or slots and tabs, can be used in place of rollers or collars. For these reasons, the invention should be construed in light of the claims.

What is claimed is:

1. An upper body exercise apparatus to assist an exerciser in performing chin-ups or dips, said exerciser having at least one arm, said arm having a length, comprising:

a frame having a base and a framepost;

a platform for supporting said exerciser movable between first and second positions, said first position being lower than said second position by a distance at least equal to about half said arm length;

at least a first handle extending from said frame;

means for exerting a force, having a component opposite a force of gravity, on said platform to produce an assist to the exerciser, the degree of said assistance provided in said first position being substantially the same as the degree of assistance provided in said second position; and a collar secured to said platform and which at least partially encompasses said framepost, said collar coupling said platform to said framepost such that said platform can move in any vertical direction relative to said framepost and cannot move in a horizontal direction relative to said framepost.

2. A chin-up dip exercise apparatus to assist an exerciser having a body weight in performing chin-ups and dips, comprising:

a frame including a pair of spaced apart, substantially parallel stationary guides oriented in a substantially vertical plane;

an exerciser lifting support platform to support the exerciser thereon, said support platform being horizontally spaced a distance away from said guides and out of said guide vertical plane sufficient to position the body of the exerciser clear of said guides when on said support platform performing chin-ups and dips;

connector guide members connected to said support platform to travel therewith as a unit, said guides each guidingly engaging at least one of said connector guide members to limit movement of said connector guide members to linear movement along said guides, said guides allowing substantially uninhibited vertical movement of said connector guide members but restraining said connector guide members against substantial horizontal movement as said connector guide members move along said guides to provide substantially linear guided vertical movement of said support platform between upper and lower end limits of vertical travel of said support platform without substantial horizontal movement of said support platform, said connector guide members holding said support platform oriented substantially horizontal as said support platform moves vertically toward and away from said upper and lower end limits of travel;

a first handle coupled to said frame for grasping by the exerciser during a chin-up exercise;

a second handle coupled to said frame below said first handle for grasping by the exerciser during a dip exercise; and a force source coupled to said support platform to supply an upward force to said support platform, said force source being selectively adjustable to select a magnitude of said upward force supplied to said support platform and thereby at least partially offset the body weight of the exerciser by a selected amount to assist the exerciser when performing chin-ups and dips.

3. The exercise apparatus of claim 2 wherein said connector guide members rollably engage said guides.

4. The exercise apparatus of claim 2 wherein said connector guide members slidably engage said guides.

5. The exercise apparatus of claim 2 wherein said force source includes a spring.

6. A chin-up dip exercise apparatus to assist an exerciser having a body weight in performing chin-ups and dips, comprising:

a frame;

a pair of spaced apart, substantially parallel guide members oriented in a substantially vertical plane;

an exerciser lifting support platform to support the exerciser thereon, said support platform being horizontally spaced a distance away from said guide members and out of said guide member plane sufficient to position the body of the exerciser clear of said guide members when on said support platform performing chin-ups and dips;

couplers connected to said support platform to travel therewith as a unit and movably coupled to said guide members, said couplers each guidingly engaging and being restrained by one of said guide members to provide linear guided movement of said support platform in a substantially vertical direction between upper and lower end limits of vertical travel of said support platform without substantial horizontal movement of said support platform, said couplers maintaining said support platform oriented substantially horizontal as said support platform moves vertically toward and away from said upper and lower end limits of travel;

a first handle coupled to said frame for grasping by the exerciser during a chin-up exercise;

a second handle coupled to said frame below said first handle for grasping by the exerciser during a dip exercise; and a force source coupled to said support platform to supply an upward force to said support platform, said force source being selectively adjustable to select a magnitude of said upward force supplied to said support platform to at least partially offset the body weight of the exerciser by a selected amount to assist the exerciser when performing chin-ups and dips.

7. The exercise apparatus of claim 6 wherein said couplers rollably engage said guide members.

8. The exercise apparatus of claim 6 wherein said couplers slidably engage said guide members.

9. The exercise apparatus of claim 6 wherein said force source includes a spring.

10. An exercise apparatus to assist an exerciser having a body weight in performing exercises, comprising:

a frame;

an upwardly extending, stationary guide member having a substantially straight length;

an exerciser lifting support platform sized to support the exerciser thereon when performing exercises, said support platform being oriented horizontally and movable along said guide member;

a guide engagement member attached to said support platform to travel therewith as a unit, said engagement member being movable along said straight length of said guide member in guiding engagement therewith as said platform moves along said guide member, said guide member restraining said engagement member against substantial horizontal movement while allowing said engagement member to move substantially uninhibited in a vertical direction so as to provide linear guided movement of said support platform in a vertical direction between upper and lower end limits of vertical travel of said support platform without substantial horizontal movement of said support platform;

at least one handle coupled to said frame for grasping by the exerciser during an exercise; and an upward force source coupled to said support platform and sized to supply a sufficiently large upward force to said support platform to at least partially offset the body weight of the exerciser thereon.

11. The exercise apparatus of claim 10 wherein said engagement member rollably engages said guide member.

12. The exercise apparatus of claim 10 wherein said engagement member slidably engages said guide member.

13. The exercise apparatus of claim 10 wherein said force source is selectively adjustable by the exerciser to select a magnitude of said upward force supplied to said support platform.

14. An exercise apparatus to assist an exerciser having a body weight in performing exercises comprising:

a frame;

an upwardly extending guide member;

an exerciser lifting support platform sized to support the exerciser thereon when performing exercises, said support platform being oriented horizontally;

a guide engagement member coupled to said support platform to travel therewith as a unit and movably coupled to said guide member in traveling engagement therewith as said engagement member guides movement of said support platform along said guide member, said engagement member engaging said guide member to permit substantially uninhibited linear guided movement of said support platform along said guide member in a vertical direction between upper and lower end limits of vertical travel of said support platform while being restrained by said guide member to substantially inhibit horizontal movement of said support platform as said support platform moves vertically along said guide member;

at least one handle coupled to said frame for grasping by the exerciser during an exercise; and an upward force source coupled to said support platform and sized to supply a sufficiently large upward force to said support platform to at least partially offset the body weight of the exerciser thereon.

15. The exercise apparatus of claim 14 wherein said force source is selectively adjustable by the exerciser to select a magnitude of said upward force supplied to said support platform.

16. The exercise apparatus of claim 14 wherein said engagement member rollably engages said guide member.

17. The exercise apparatus of claim 14 wherein said engagement member slidably engages said guide member.

18. An exercise apparatus to assist an exerciser having a body weight in performing exercises, comprising:

a frame;

an exerciser support platform sized to support the exerciser thereon when performing exercises, said support platform being oriented horizontally;

a connector member coupled to said support platform to travel therewith as a unit;

an elongated, upwardly extending stationary guide with said connector member in traveling engagement therewith to guide movement of said support platform along said guide, said guide being engaged by said connector member to permit substantially uninhibited linear guided movement of said support platform along said guide in a substantially vertical direction between upper and lower end limits of vertical travel of said support platform while restraining said support platform against substantial horizontal movement as said support platform moves vertically along said guide member;

at least one handle coupled to said frame for grasping by the exerciser during an exercise; and a motive force device coupled to said support platform to supply an upward force thereto of sufficient size to at least partially offset the body weight of the exerciser on said support platform.

19. The exercise apparatus of claim 18 wherein said guide includes a substantially straight, vertically oriented guide member engaged by said connector member.

20. The exercise apparatus of claim 18 wherein said device is selectively adjustable by the exerciser to select a magnitude of said upward force supplied to said support platform.

21. An exercise apparatus to assist an exerciser having a body weight in performing exercises, comprising:

a frame;

a cantilevered support platform sized to support the exerciser thereon when performing exercises, said support platform having a free first end and a second end opposite said first end, said support platform being oriented horizontally;

a connector member attached to said support platform toward said support platform second end to travel with said support platform as a unit;

an elongated, upwardly extending stationary guide with said connector member movably coupled thereto to guide movement of said support platform along said guide with said support platform first end spaced away from said guide, said guide being engaged by said connector member and restraining said connector member against substantial horizontal movement while allowing said connector member to move substantially uninhibited in a vertical direction along said guide so as to provide linear guided movement of said support platform in a substantially vertical direction between upper and lower end limits of vertical travel of said support platform without substantial horizontal movement of said support platform;

a handle coupled to said frame for grasping by the exerciser during an exercise; and a motive force device coupled to said support platform to supply an upward force thereto of sufficient size to at least partially offset the body weight of the exerciser on said support platform.

22. The exercise apparatus of claim 21 wherein said guide includes a substantially straight, vertically oriented guide member engaged by said connector member.

23. The exercise apparatus of claim 21 wherein said guide includes a pair of spaced apart, substantially straight, vertically oriented guide members, and said connector member includes a pair of rollers, each rollably engaging one of said pair of guide members.

24. The exercise apparatus of claim 21 wherein said device is selectively adjustable by the exerciser to select a magnitude of said upward force supplied to said support platform.

* * * * *